US006170425B1

(12) United States Patent
Blount

(10) Patent No.: US 6,170,425 B1
(45) Date of Patent: Jan. 9, 2001

(54) BOAT HULL CONSTRUCTION AND METHOD OF MAKING THE SAME

(75) Inventor: Luther H. Blount, Warren, RI (US)

(73) Assignee: Hitech Ultralight Catamaran, Ltd., Warren, RI (US)

( * ) Notice: Under 35 U.S.C. 154(b), the term of this patent shall be extended for 0 days.

(21) Appl. No.: 09/354,362

(22) Filed: Jul. 14, 1999

(51) Int. Cl.[7] ..... B63B 3/00
(52) U.S. Cl. ..... 114/356; 114/357
(58) Field of Search ..... 114/355, 356, 114/357

(56) References Cited

U.S. PATENT DOCUMENTS

| | | | | |
|---|---|---|---|---|
| 2,121,052 | * | 6/1938 | Roberts et al. | 114/292 |
| 2,877,877 | | 3/1959 | Davis, Jr. | 189/85 |
| 3,190,408 | | 6/1965 | Petterson | 189/36 |
| 3,214,888 | | 11/1965 | Ridder | 52/499 |
| 3,760,439 | * | 9/1973 | Swenson, Sr. | 114/356 |
| 3,811,141 | | 5/1974 | Stoeberl | 9/6 |
| 3,849,013 | * | 11/1974 | Bibb | 403/347 |
| 4,073,049 | * | 2/1978 | Lint | 29/458 |
| 4,303,033 | * | 12/1981 | King | 114/61.22 |
| 4,365,580 | | 12/1982 | Blount | 114/386 |
| 4,572,096 | | 2/1986 | Payne | 114/88 |
| 4,870,919 | * | 10/1989 | Allison | 114/288 |
| 4,892,054 | * | 1/1990 | Davidson | 114/357 |
| 4,993,350 | * | 2/1991 | Pepper | 114/292 |
| 5,088,434 | | 2/1992 | Harding | 114/85 |
| 5,601,049 | * | 2/1997 | Hordis et al. | 114/357 |

* cited by examiner

*Primary Examiner*—S. Joseph Morano
*Assistant Examiner*—Andy Wright
(74) *Attorney, Agent, or Firm*—Barlow, Josephs, & Holmes, Ltd.

(57) ABSTRACT

A composite hull construction includes a metallic skeletal frame of truss-like configuration including a longitudinally extending keel plate, first and second side wall structures extending upwardly from opposing side edges of the keel plate assembly, and a top wall structure extending between upper portions of the first and second side wall structures. A synthetic foam shell entirely encapsulates the side and top wall frame structures and covers the interior surfaces of the keel plate assembly. The foam shell rigidly fixes the frame members in position and increases the compressive strength of the skeletal frame to prevent buckling of the side wall and top wall structures. An exterior fiberglass skin covers the side walls and the top wall to provide a water resistant covering over the foam shell and skeletal frame. The hull further includes an integrated fire suppression system that detects heat/smoke within the hull and automatically dispenses a fire suppression agent, such as carbon dioxide to the interior of the hull.

30 Claims, 12 Drawing Sheets

BOAT HULL CONSTRUCTION AND METHOD OF MAKING THE SAME

BACKGROUND AND SUMMARY OF THE INVENTION

The instant invention relates to boat hull constructions and more particularly to a composite metal frame/foam core boat hull construction.

Over the past several years, the need for intermediate size (40–100 feet), high speed ferry vessels has grown significantly. However, existing boat constructions have been unable to provide the desired combination of weight, speed, safety and cost which is essential for the successful operation of such ferry services. In the past, fiberglass hulls have been utilized to provide light weight boats. However, the practical size limit of fiberglass hulls is about 65 feet. Furthermore, fiberglass hulls of greater than 40 feet require a multilayer fiberglass laminate construction which is extremely difficult to construct, and thus expensive. Another means of achieving a light weight hull construction is the use of composite metal/foam/fiberglass hull constructions which provide the combined features of lighter weight and safety, i.e. foam buoyancy. In this regard, the Blount U.S. Pat. No. 4,365,580 represents the closest prior art to the present invention of which the applicant is aware. The Blount patent discloses a composite hull construction for boats including a rigid box-like cockpit structure which provides the main structural element of the boat, and a synthetic foam core bonded to the exterior surfaces of the box-like structure. The exterior surface of the foam is formed to define the outer configuration of the hull and a layer of resin impregnated glass fiber material is layed-up over the foam to provide a protective outer covering. While effective, there is nevertheless a need for creating hull structures which are even lighter in weight, and more structurally sound than the previous designs.

The instant invention provides a composite hull construction including a metallic skeletal frame of truss-like configuration. The frame includes a longitudinally extending keel plate, first and second side wall structures extending upwardly from opposing side edges of the keel plate assembly, and a top wall structure extending between upper portions of the first and second side wall structures. The side walls and top walls are formed in discrete truss-like frame sections separated by vertical dividing walls. A synthetic foam shell entirely encapsulates the frame elements of the side and top wall frame structures and covers the interior of the keel plate assembly. Preferably, the foam shell is formed by applying three separate layers of polyurethane foam materials over the frame elements until they are fully encapsulated. The outer layer of foam is about 0.5 inches thick and comprises a foam composition having a density of about 30 pounds per square foot, the intermediate layer is about 1.0 inch thick and comprises a foam composition having a density of about 10 pounds per square foot, and the inner layer is about 2–3 inches thick and comprises a foam composition having a density of about 2 pounds per square foot. Once cured, the rigid foam shell binds the frame elements in position and increases the strength of the skeletal frame in compression so that the wall structures are prevented from buckling under a compressive load. The foam encapsulation enables the entire frame structure and individual truss or frame elements to be fabricated from lighter weight materials than if the frame elements were not encapsulated in foam. An exterior fiberglass skin covers the side walls and the top wall to provide a water resistant covering over the foam shell and frame. The fiberglass skin is stretched over the side walls and top walls with terminal edges of the fiberglass material keel secured within spline channel members attached to the keel plate. Alternatively, metallic plates can be secured over the side walls and top wall to provide an outer covering to the hull structure. The hull further incorporates a fire suppression system which provides compartmentalized fire suppression in the event of a fire on board. In this regard, the hull is divided into a plurality of separate compartments by solid dividing walls. The interior dividing walls in each compartment are provided with cut-outs which both reduce weight and allow air flow from section to section. A plurality of heat and/or smoke sensors are located within the compartments, and a central carbon dioxide source with gas lines to each compartment are provided for flooding carbon dioxide into the hull compartments upon detection of excess heat and/or smoke. The described hull construction allows intermediate size, light weight boats to be constructed at a reduced cost with better safety features, i.e. higher buoyancy.

Accordingly, among the objects of the instant invention are: the provision of a light weight, structurally sound hull construction; the provision of a low cost hull construction; the provision of a highly buoyant hull construction which is extremely safe and unlikely to sink in the event of an accident; the provision of a hull construction having an integrated fire suppression system built into each discrete hull compartment, the provision of a hull construction comprising an interior skeletal frame having the structural frame members encapsulated in a foam shell which adds structural integrity to the frame construction; the provision of a multilayer foam shell wherein an outer shell layer is formed from 30 lb./sq. ft foam, an intermediate layer is formed from 10 lb./sq. ft foam, and an inner layer is formed from 2 lb./sq. ft foam; and the provision of a hull construction wherein a fiberglass skin is secured within spline channels attached to the keel plate of the skeletal frame.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
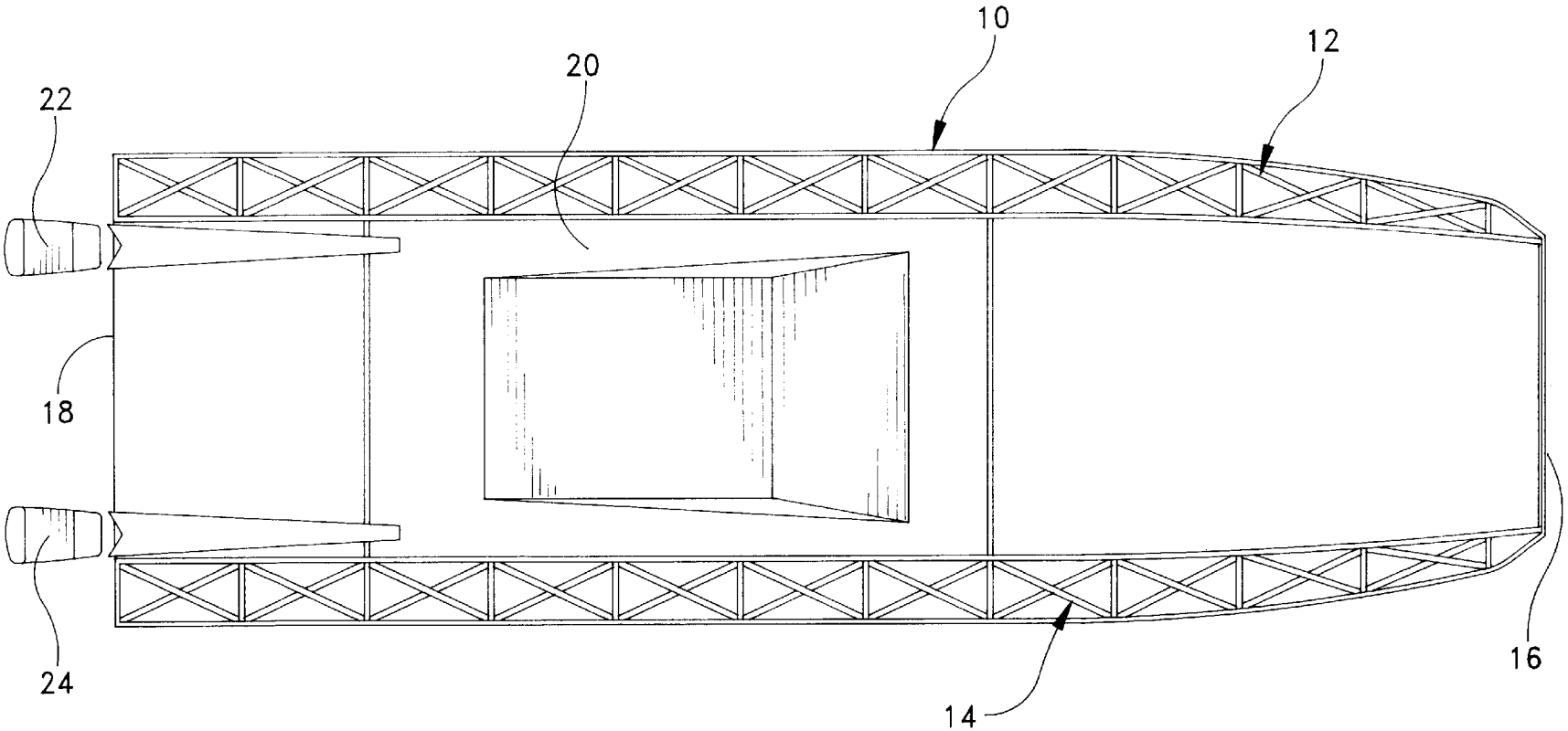
FIG. 1 is a top view of a dual-hull marine vessel incorporating the hull construction of the present invention.

Referring now to the drawings, a dual-hull marine vessel having two separate hull constructions in accordance with the present invention is generally indicated at 10. The vessel 10 includes left and right hull constructions generally indicated at 12 and 14. The front and rear portions of the hulls 12, 14 are secured together with reinforcing members 16 and 18 respectively. A central cockpit area 20 spans the central portions of the hull constructions 12, 14. Twin outboard engines 22, 24 are mounted to reinforced engine mounts at the rear of the vessel structure 10. The vessel is designed so that each of the hull sections 12, 14 are formed as individual units, i.e. constructed separate from each other. The hull units 12, 14 are then connected together with the front and rear members 16 and 18 and the central cockpit area by means of fastener systems which will allow for assembly and disassembly of the structure for transportation and storage.

Referring to FIGS. 1–5, each of the hull constructions 12 and 14 are identical in construction, comprising mirror images of each other. To facilitate further discussion and disclosure of the invention, the description of the hull structures 12, 14 will proceed with reference only to a single hull construction 12.

Figure 6:
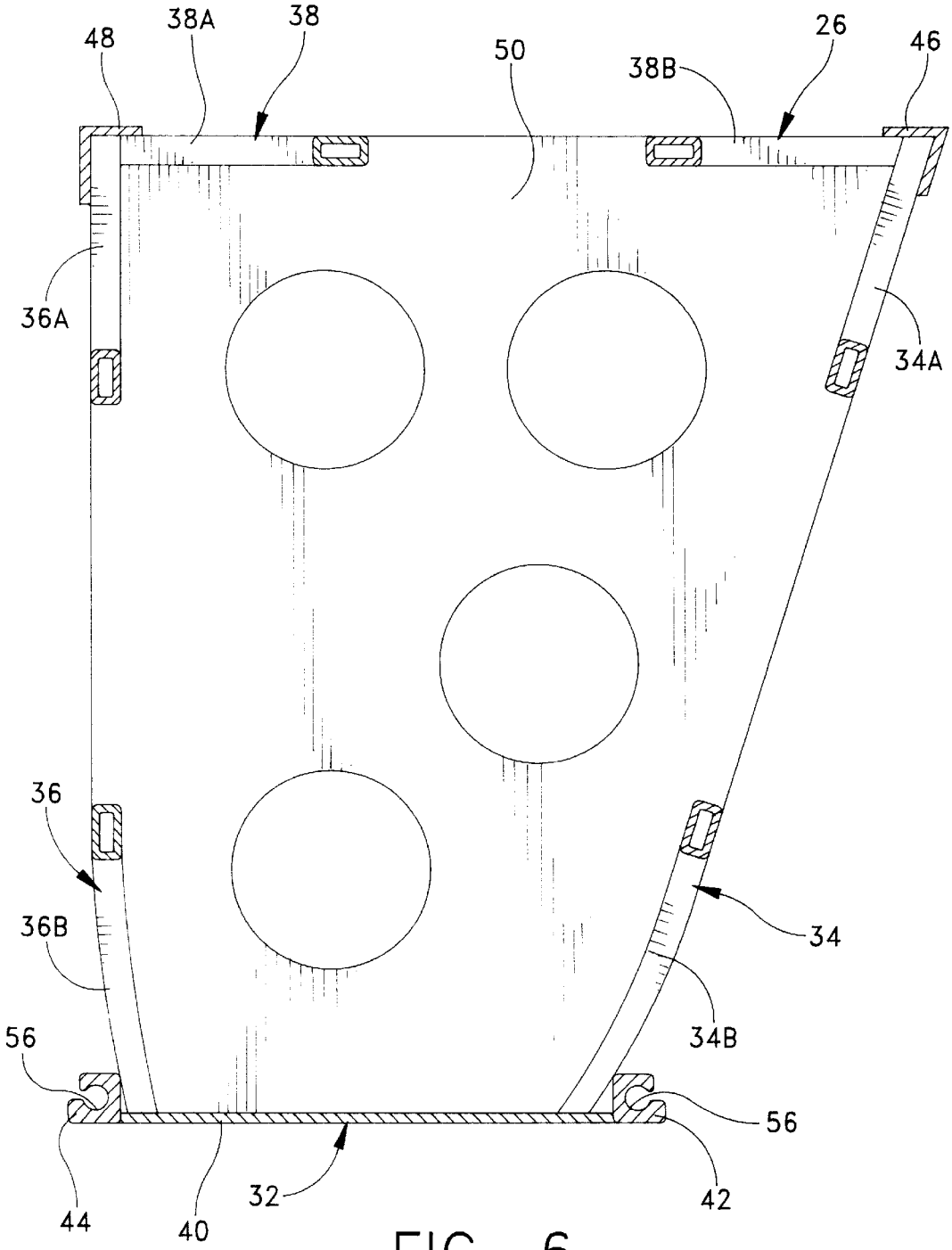
FIG. 6 is a cross-sectional view of the skeletal frame as taken along line 6–6 of FIG. 4.
Figure 10:
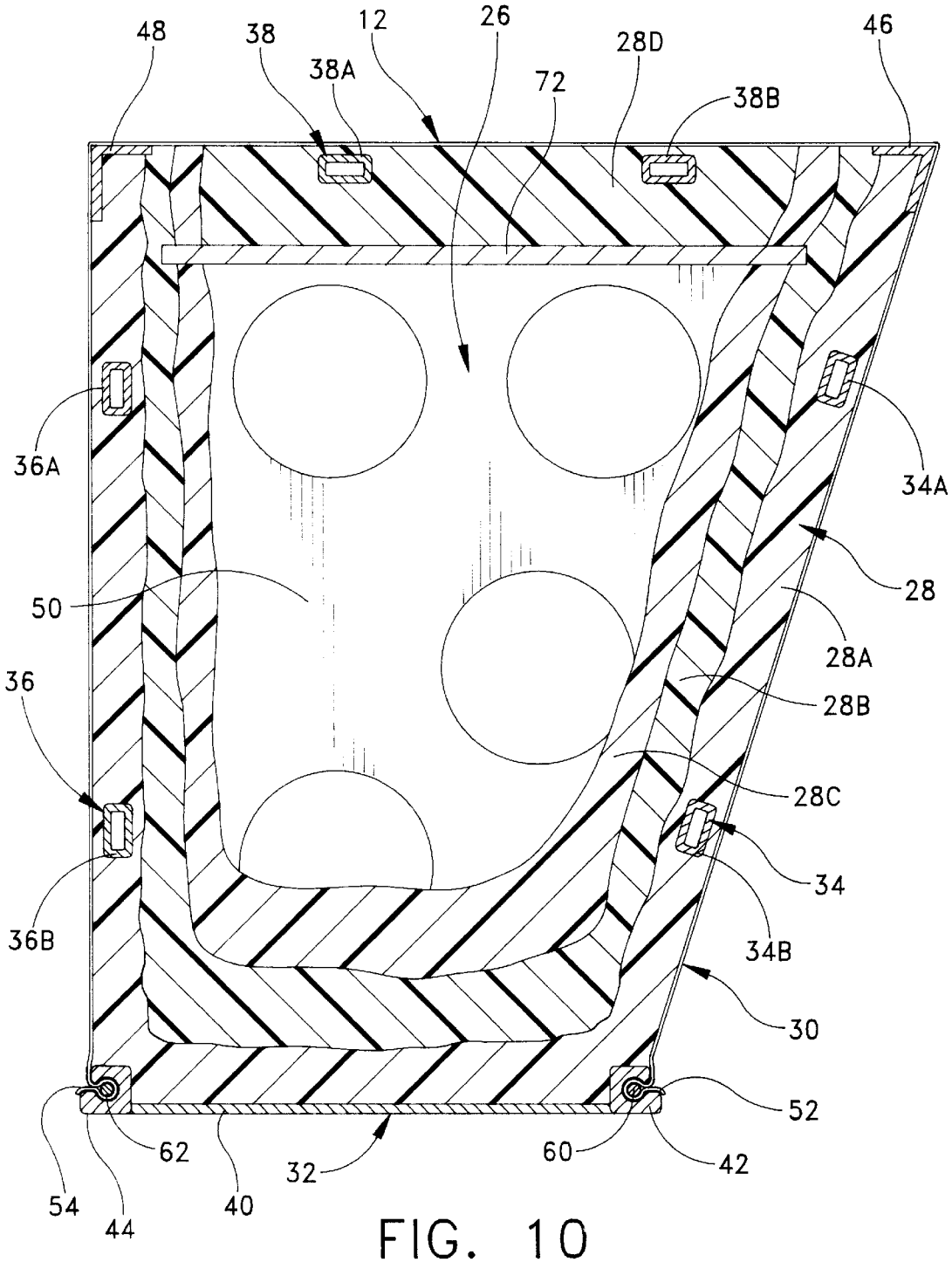
FIG. 10 is still another view with the exterior fiberglass skin applied over the outer surface of the cured foam.
Figure 11:
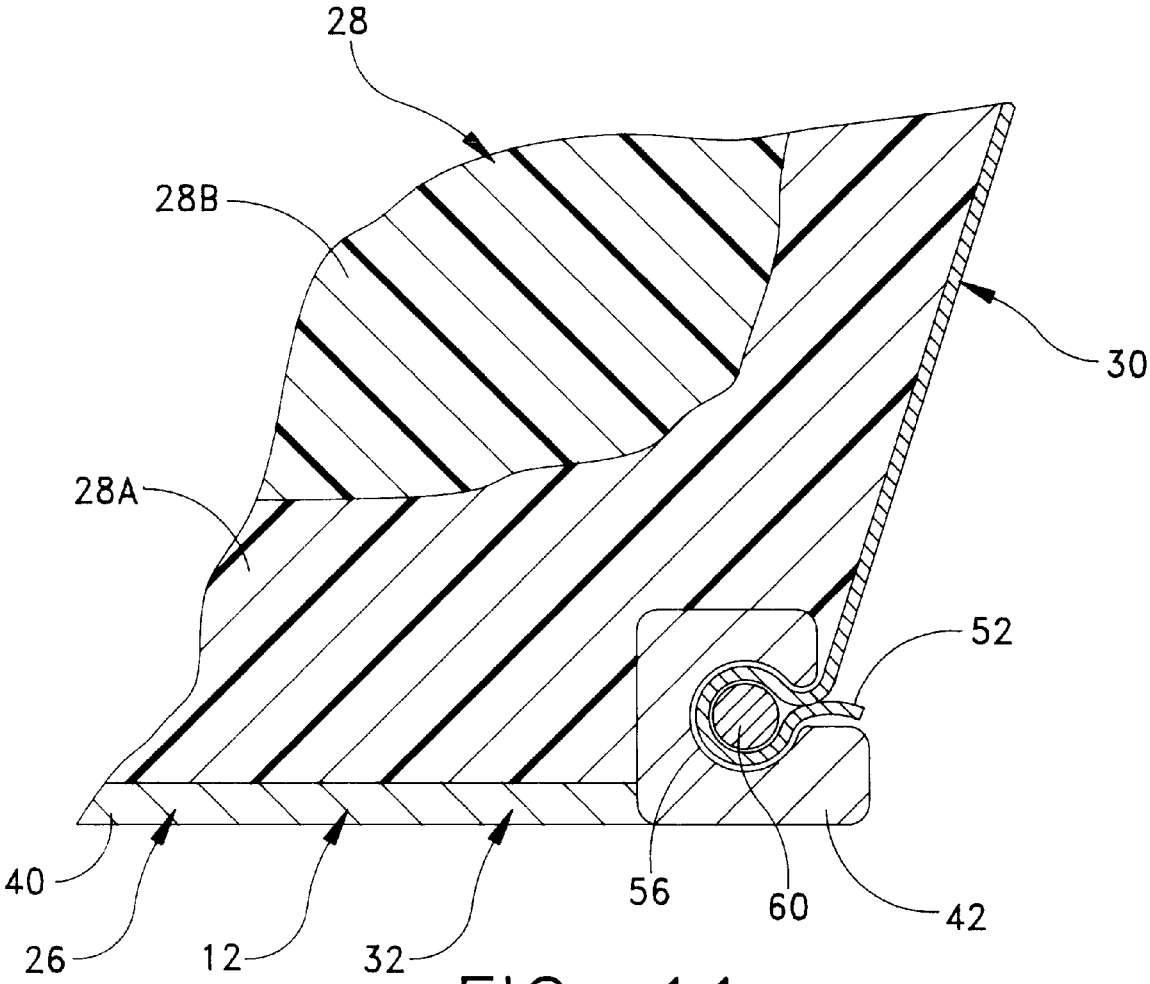
FIG. 11 is an enlarged fragmentary view of one of the spline channels.

The composite hull construction 12 comprises a metallic skeletal frame generally indicated at 26 (See FIGS. 4–6), a synthetic foam shell generally indicated at 28 which entirely encapsulates the frame 26 (see FIG. 10), and an exterior skin generally indicated at 30 (See FIGS. 10 and 11).

Figure 2:
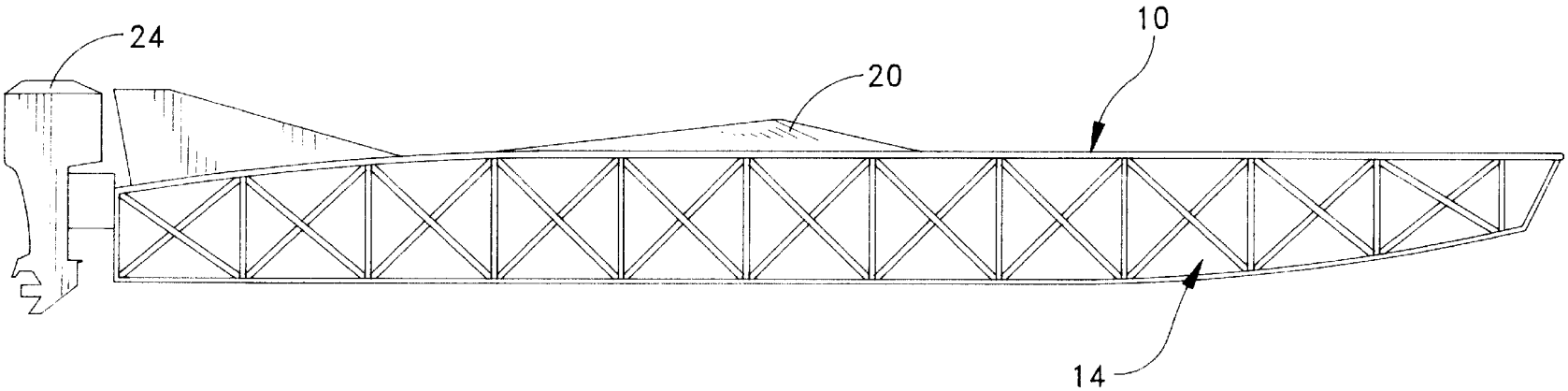
FIG. 2 is a side view thereof.
Figure 3:
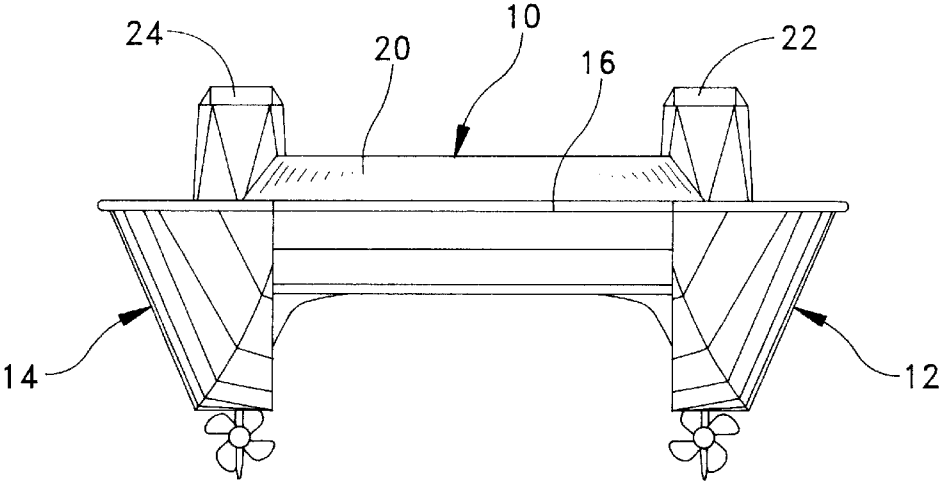
FIG. 3 is a front view thereof.
Figure 4:
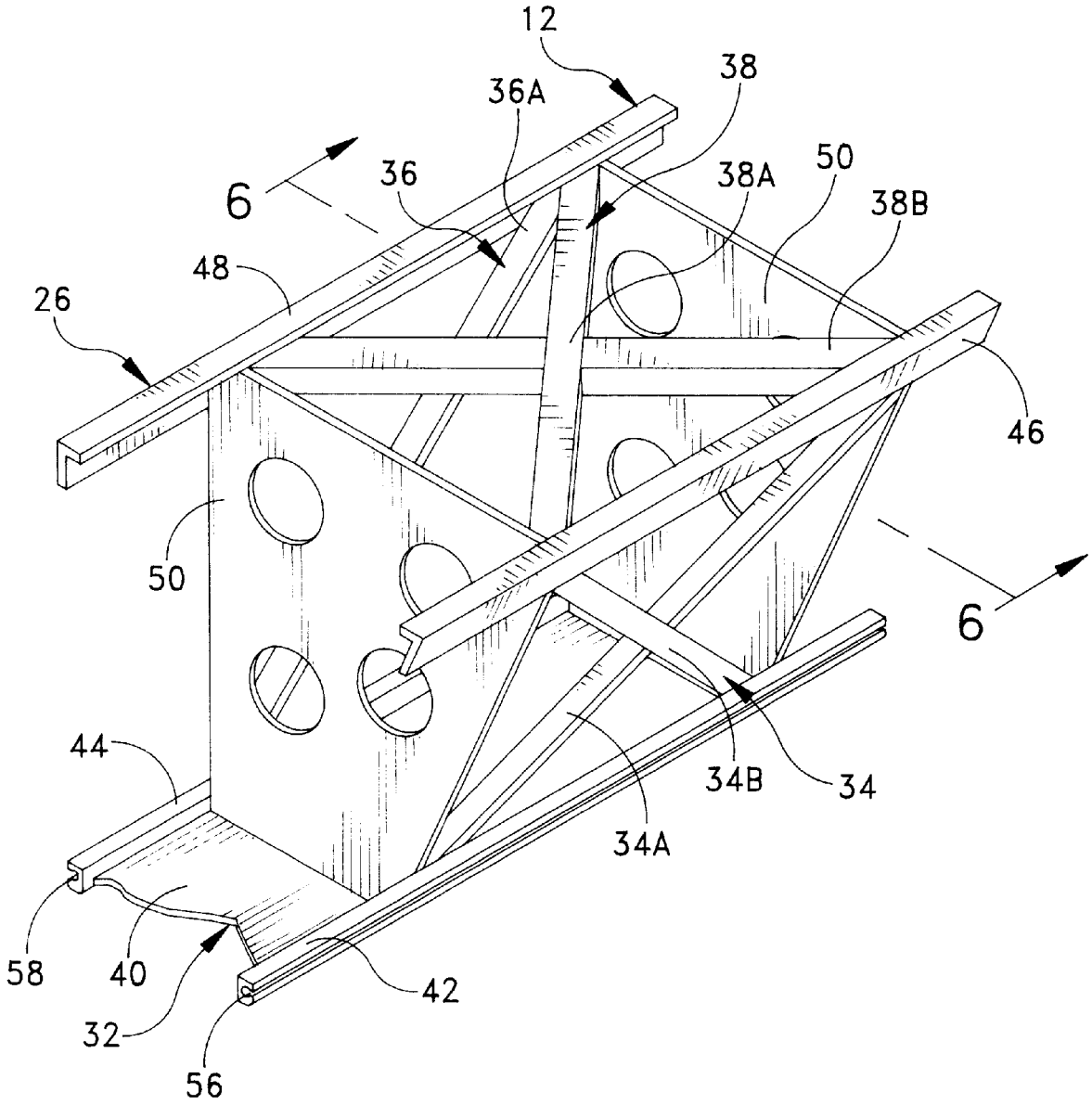
FIG. 4 is a fragmented perspective view of a portion of one of the skeletal frames of one of the hulls vessel.
Figure 5:
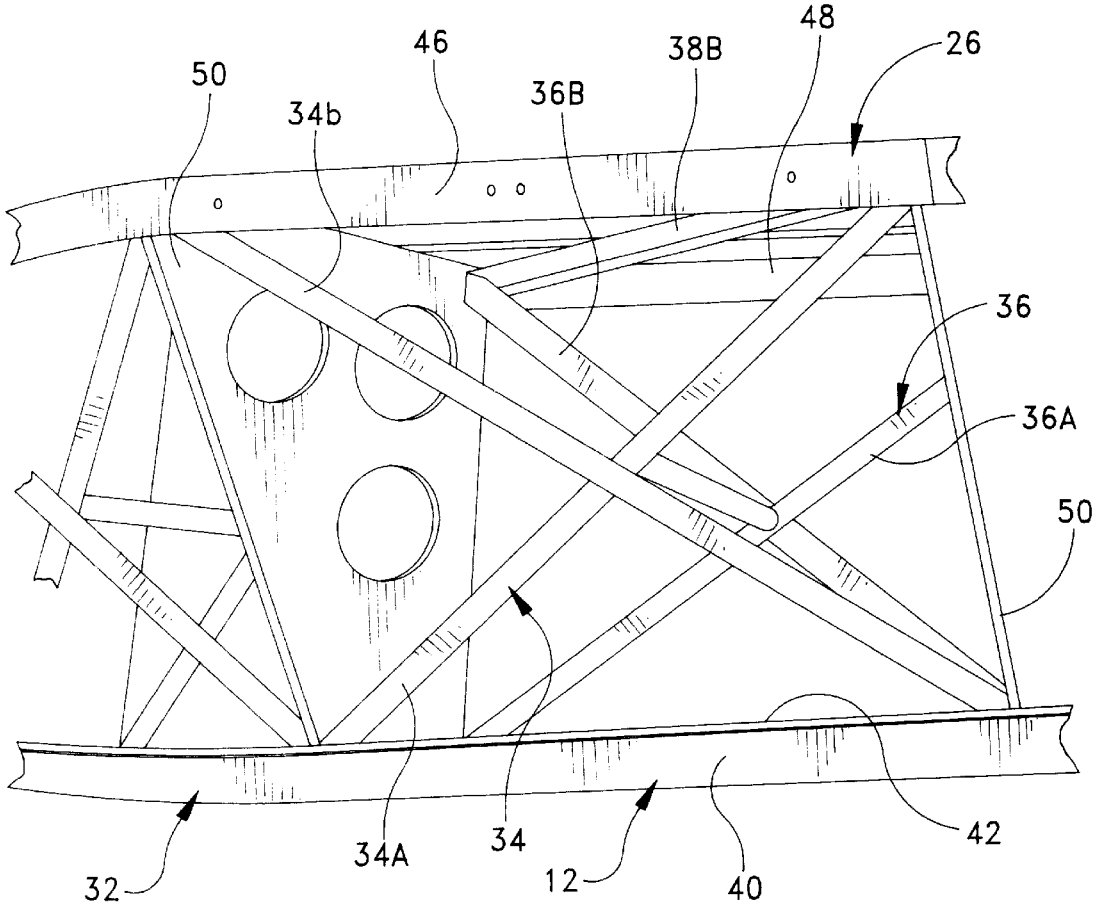
FIG. 5 is fragmented perspective view of another portion of the skeletal frame.

The frame 26 includes a longitudinally extending keel plate assembly generally indicated at 32, first and second side wall structures generally indicated at 34, 36 respectively extending upwardly from opposing side edges of the keel plate assembly 32, and a top wall structure generally indicated at 38 extending between upper portions of the first and second side wall structures 34, 36. Unless otherwise indicated herein, all of the elements of the frame structure 26 are fabricated from aluminum components, and either welded together or fastened together using conventional fastener elements. The keel plate assembly 32 comprises a longitudinally extending keel plate 40 having first and second opposing side edges, and first and second spline channel members 42, 44 respectively attached to the opposing side edges of the keel plate 40. The keel plate assembly 32 extends for the entire length of the hull construction 12 as illustrated in FIGS. 1–3. The frame 26 further includes first and second longitudinally extending upper corner members 46, 48 respectively which are positioned in spaced relation above the spline channel members 42, 44 by a plurality of vertical dividing walls 50 longitudinally spaced along the entire length of the hull 12. At spaced intervals along the length of the hulls, selected dividing walls 50A and 50B are constructed in a solid configuration to define compartments 51A, 51B, and 51C within the hull (see FIG. 13). Other interior dividing walls 50 are provided with circular cut-outs to reduce the overall weight of the hull and to provide air flow within the respective compartment. These compartments are utilized in connection with a fire suppression system to be described at a later point in the description. The side walls 34, 36 and top wall 38 are formed in discrete truss-like frame sections separated by the vertical dividing walls 50. Each of the side wall and top wall sections 34, 36, 38 is comprised of a plurality of individual frame members 34A, 34B, 36A, 36B, 38A, 38B welded to each other, to the keel plate 40, to the dividing walls 50 and to the corner members 46, 48 to provide an integrated truss configuration which has superior tensile and compressive strength. While the frame 26 has been specifically been described as a rectangular construction having essentially four walls, it is to be understood that the present hull construction is equally applicable to other hull designs incorporating other geometric configurations, and having more or less than 4 walls.

Referring to FIGS. 10, the synthetic foam shell 28 entirely encapsulates the frame elements 34A, 34B, 36A, 36B, 38A, 38B of the side and top wall frame structures 34, 36, 38 and covers the interior surface of the keel plate assembly 32. The keel plate assembly 32 and the outer surfaces of the foam shell 28 cooperate to define the exterior configuration of the hull 10. The foam shell 28 is preferably comprised of synthetic foam material, such as a hardening-type polyurethane foam, although other suitable synthetic foam materials my be employed as desired. More specifically, the foam shell 28 comprises three separate layers of polyurethane foam materials. The outer layer of foam 28A is about 0.1 to 1.0 inch thick, and comprises a foam composition having a density of between about 20 to about 40 pounds per square foot. The intermediate layer 28B is about 0.5 to about 2.0 inches thick, and comprises a foam composition having a density of between about 5 pounds per square foot to about 15 pounds per square foot. The inner layer 28C is about 1–5 inches thick and comprises a foam composition having a density of about 1 pound per square foot to about 5 pounds per square foot. In a preferred embodiment, the outer layer of foam 28A is about 0.5 inches thick and comprises a foam composition having a density of about 30 pounds per square foot, the intermediate layer 28B is about 1.0 inch thick and comprises a foam composition having a density of about 10 pounds per square foot, and the inner layer 28C is about 2–3 inches thick and comprises a foam composition having a density of about 2 pounds per square foot. The foam shell 28 binds all the frame elements, 32 (keel plate assembly), 34A, 34B, 36A, 36B, 38A, 38B, 46, 48 and 50 in position and increases the compressive strength of the skeletal frame 26 so that the side wall and top wall structures 34, 36, 38 are prevented from buckling under a compressive load. The foam encapsulation enables the entire skeletal frame structure 26 and individual frame elements to be fabricated from lighter weight materials than if the frame elements were not encapsulated in foam. Furthermore, it can be appreciated that since the foam shell 28 occupies a considerable volume within the hull, it acts as a floatation material, making the hull construction highly buoyant and unlikely to sink in the event of an accident which punctures the hull.

Referring to FIGS. 10 and 11, an exterior fiberglass skin 30 covers the top and side outer surfaces of the foam shell 28 to provide a water resistant covering over the skeletal frame 26. Resin impregnated fiberglass materials of the type contemplated herein, and the methods of application thereof, are well-known in the boat art, and will not be further described herein. The resin impregnated fiberglass material 30 is stretched over the side walls and top walls with opposing terminal edges 52, 54 of the fiberglass material 30 secured within channels 56, 58 respectively in the spline channel members 42, 44 which are attached to the keel plate 40. The terminal edges 52, 54 of the fiberglass material 30 are inserted into the channels 56, 58 and secured in place with a spline 60, 62, such as a rope or cord sized to snugly fit into the channel 56, 58 with the fiberglass material 30 wrapped around the spline (See FIG. 11). Remaining edges of the fiberglass material 30 can be trimmed after they are secured within the channel. Since the fiberglass skin 30 does not operate as the main structural component of the hull, it is of substantially less thickness than would normally be necessary for a conventional fiberglass vessel of comparable size. It is also noted that the exterior layer 28A of 30 lb./sq. ft. foam has a strength similar to that of fiberglass, and provides additional structural stability to the outer skin. Standard impact tests, i.e. dropping of weights onto the finished surfaces, show that the structural integrity of the outer walls 34, 36, 38 exceed current Coast Guard standards. Subsequent to the curing of the fiberglass skin, the exterior surfaces may be further finished to provide a smooth outer surface for painting or other finish coating as desired.

Figure 13:
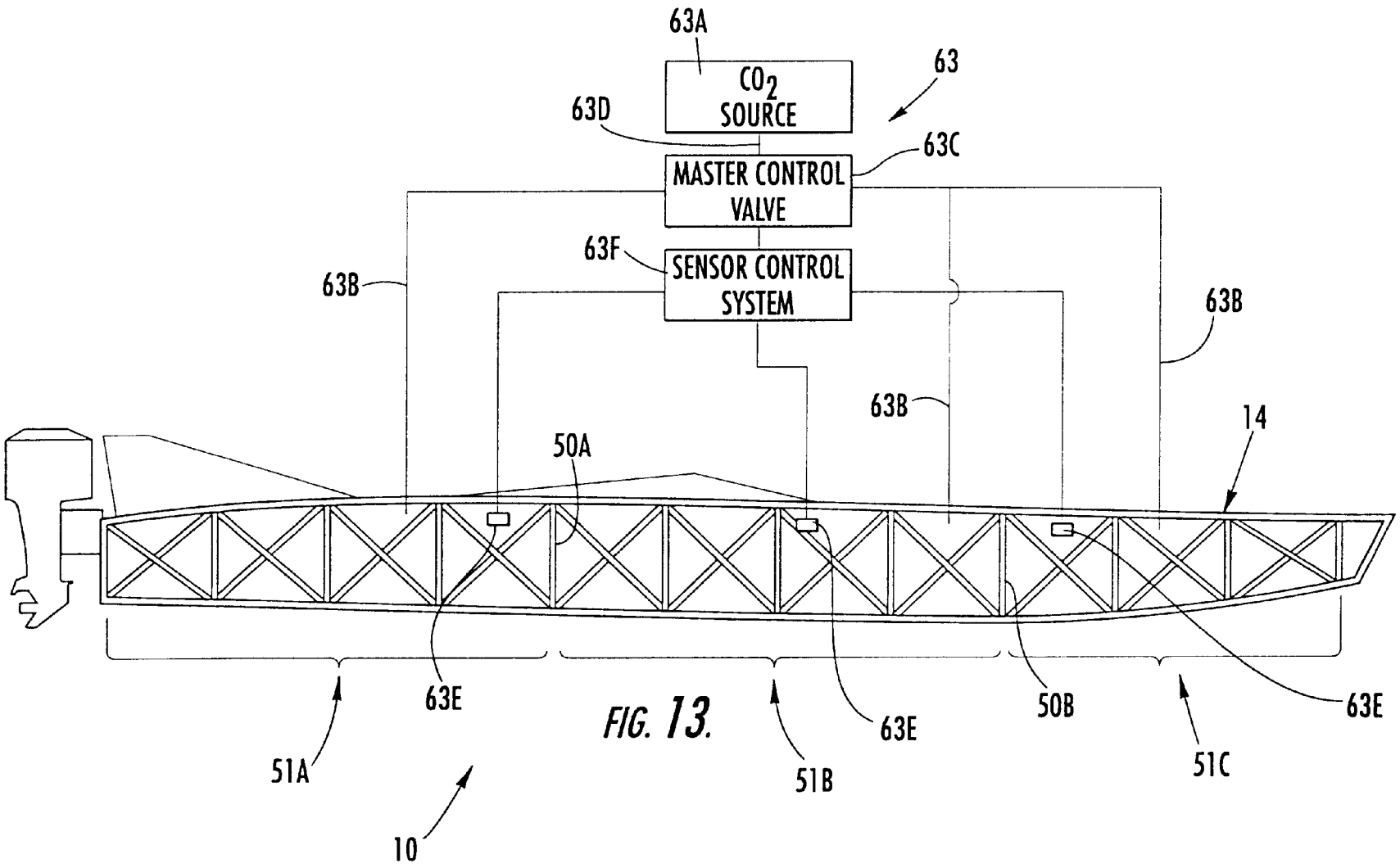
FIG. 13 is a schematic illustration of the hull compartments, and the integrated fire suppression system.

Turning to FIG. 13, a fire suppression system generally indicated at 63 is provided for added safety of the boat. Since fuel tanks, bilge pumps, electrical wiring and other potential sources of fire are located within the hulls, it is an important safety feature to provide a fire suppression system within the hull. The fire suppression system 63 comprises a source of a fire suppression agent 63A, such as carbon diode ($CO_2$), a plurality of supply lines 63B extending from the ($CO_2$) source 63A into each compartment for supplying ($CO_2$) to each compartment, a master valve 63C positioned in the main ($CO_2$) supply line 63D to control the flow of ($CO_2$) to each compartment, a plurality of heat/smoke sensors 63E respectively located in each compartment for sensing fire/smoke within each compartment, and a sensor control system 63F which monitors the sensors 63E and controls operation of the master valve 63C. Individual valves could also be provided for each discrete compartment. As previously described hereinabove, the hull 12 is divided into three separate compartments 51A, 51B, and 51C by solid vertical dividing walls, 50A and 50B thereby containing any fire or smoke to within a limited portion of the hull. In the event that a fire/smoke is detected, one of the sensors 63D will trigger the sensor control system 63F to open the valve 63C to flood all of the compartments with ($CO_2$) to smother the fire, in the case of individual valves, to flood the respective compartment in which fire/smoke is detected.

Method of Fabrication

Figure 7:
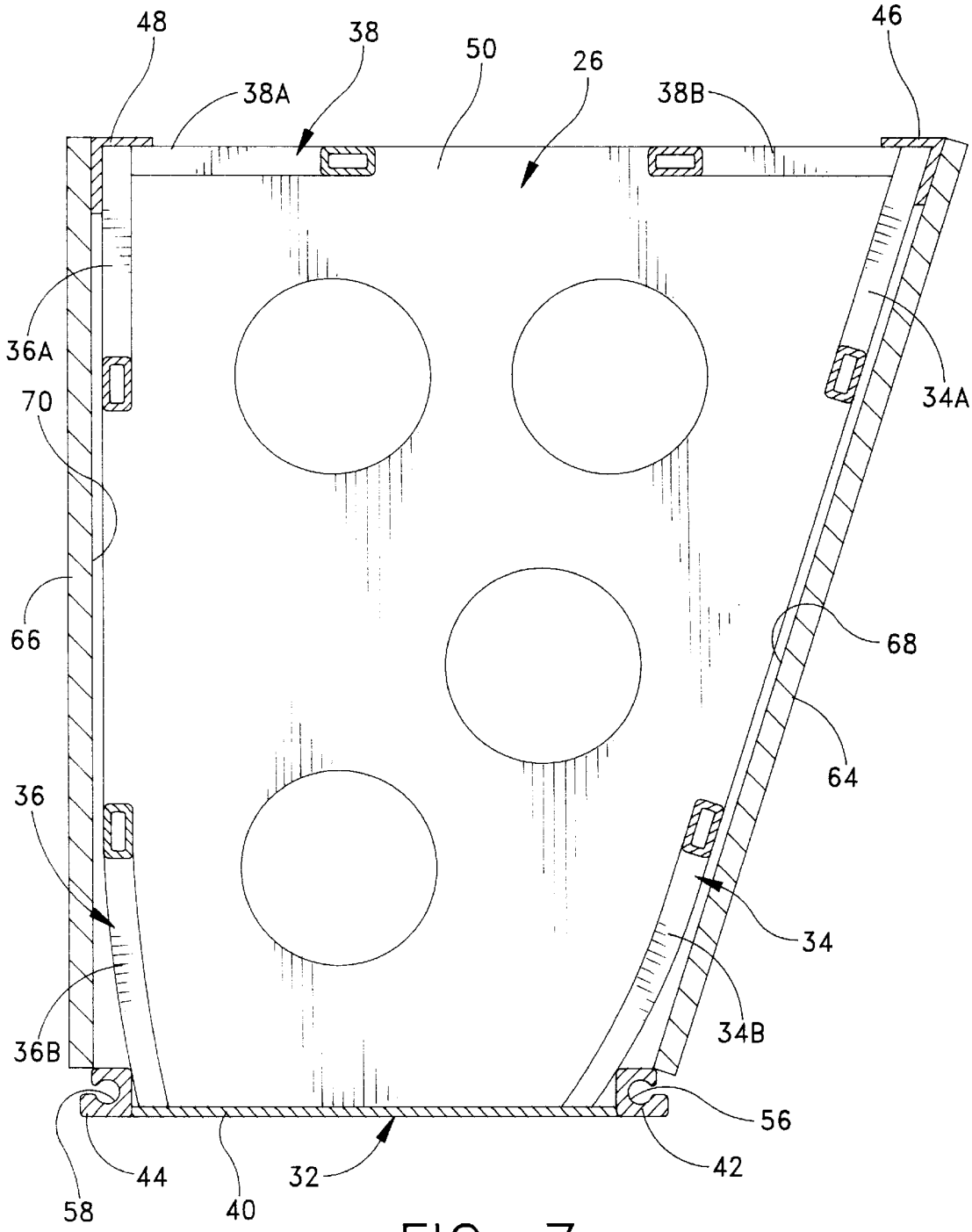
FIG. 7 is a similar view thereof with exterior wall forms positioned adjacent to the side wall structures of the skeletal frame.

Referring now to FIGS. 7–10, a preferred method of applying the foam layers 28 and attaching the fiberglass skin 30 is disclosed. Referring to FIG. 7, once the skeletal frame 26 is completed, side wall forms 64, 66 are positioned in place adjacent to the side walls 34, 36 of the frame 26. The forms 64, 66 are preferably constructed from a flexible sheet material, and the interior surfaces 68, 70 of the forms preferably have a surface coating which does not adhere to the foam to be applied thereto. This non-stick coating facilitates removal of the forms after foaming, and provide a smooth outer surface to receive the fiberglass skin.

Figure 8:
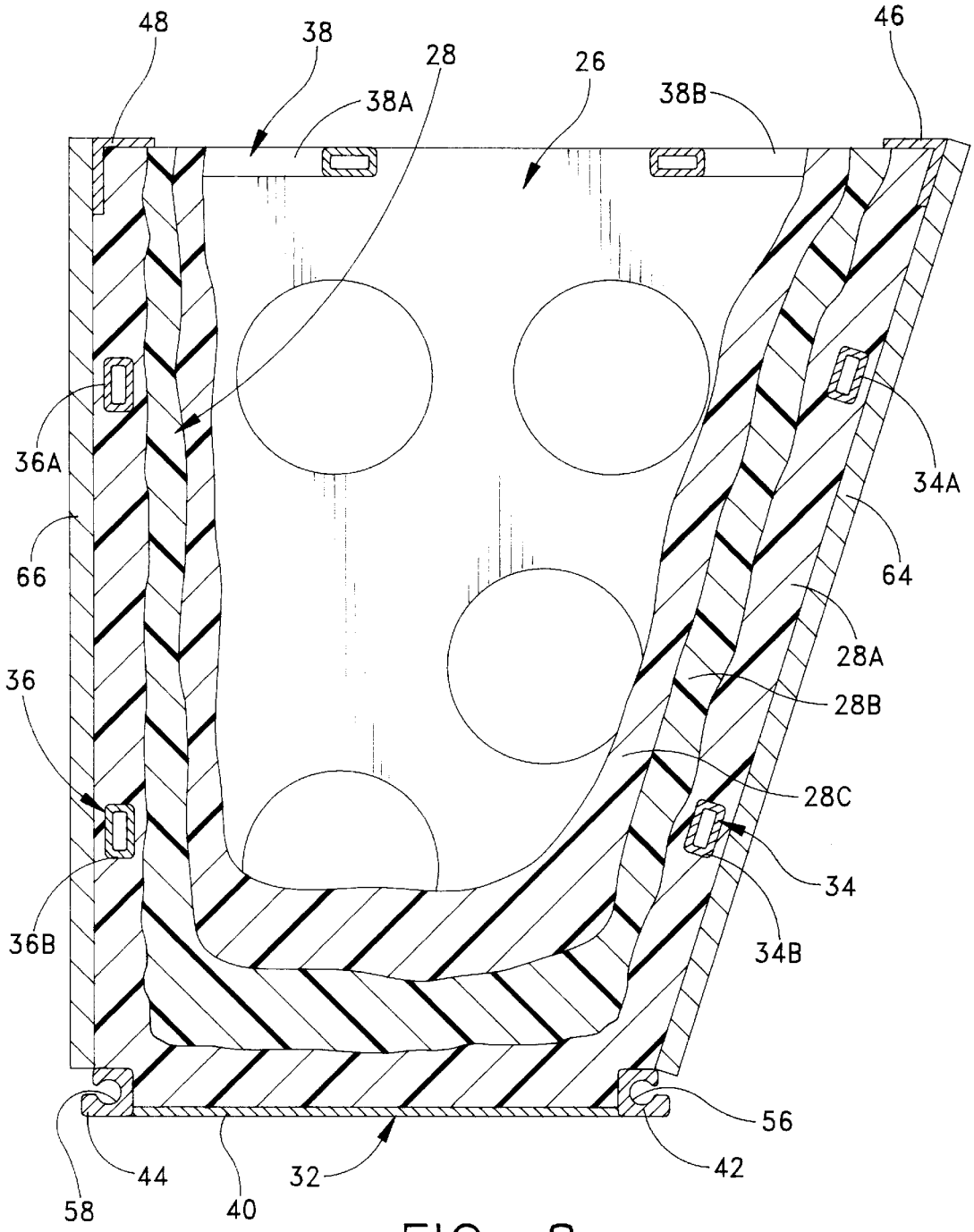
FIG. 8 is another view thereof with first, second and third layers of uncured foam applied to the bottom and side areas of the frame.
Figure 9:
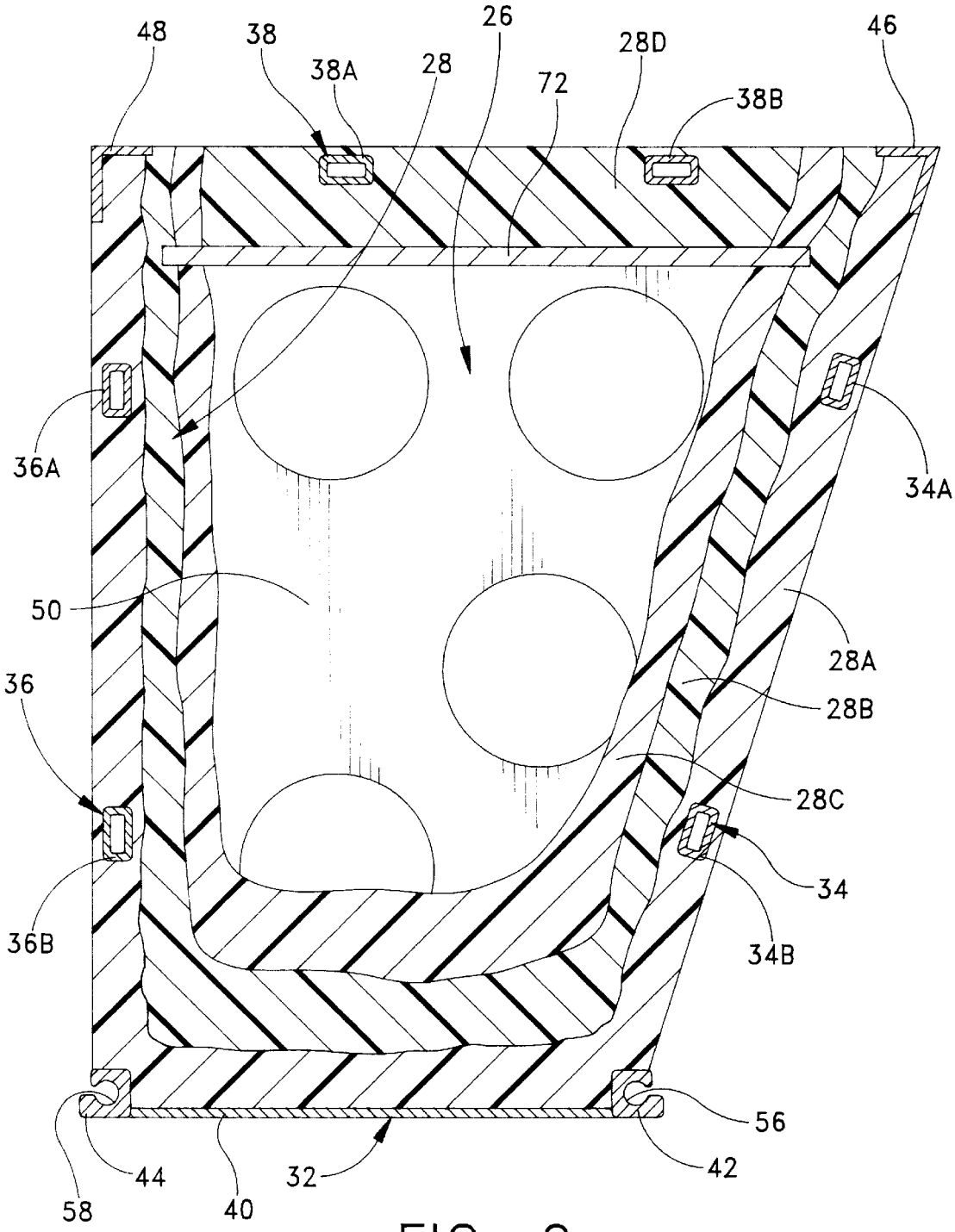
FIG. 9 is yet another view thereof with a support panel inserted into the uncured foam and a body of uncured foam applied to the top of the support panel.

Referring to FIG. 8, the side and bottom portions of the foam shell 28 are formed by applying three successive layers of foam 28A, 28B, 28C over the side wall elements 34A, 34B, 36A, 36B and the keel frame assembly 32 elements until they are fully encapsulated. The outer layer 28A is about 0.5 inches thick and comprises a foam composition having a density of about 30 pounds per square foot, the intermediate layer 28B is about 1.0 inch thick and comprises a foam composition having a density of about 10 pounds per square foot, and the inner layer 28C is about 2–3 inches thick and comprises a foam composition having a density of about 2 pounds per square foot. While the just applied foam is still wet, a support panel 72 is suspended in the foam layers 28A, 28B, 28C to provide a base to receive an upper layer of foam 28D which will encapsulate the top wall 38 (See FIG. 9). The support panel 72 can comprise a rigid corrugated cardboard panel, metal panel, or any other suitable panel which can be supported in the foam and provide a solid base for the upper foam layer 28D. A layer 28D of polyurethane foam having a density of about 10 pounds per square foot is then applied over the support panel 72 to encapsulate the top wall frame members 38A, 38B. The foam shell 28 is then allowed to cure with the forms 64, 66 in place, and thereafter the forms are removed. After the forms are removed, the exterior surfaces of the foam shell 28 are examined and excess foam removed. The exterior fiberglass skin 30 is then layed-up over the outer surfaces of the foam shell 28 (FIGS. 10 and 11), the opposing terminal edges 52, 54 secured with a spline 60, 62 in the spline channels 56, 58 of the spline channel members 42, 44, and the resin cured so that the fiberglass skin 30 is directly adhered to the outer surface of the foam shell 28.

Figure 12:
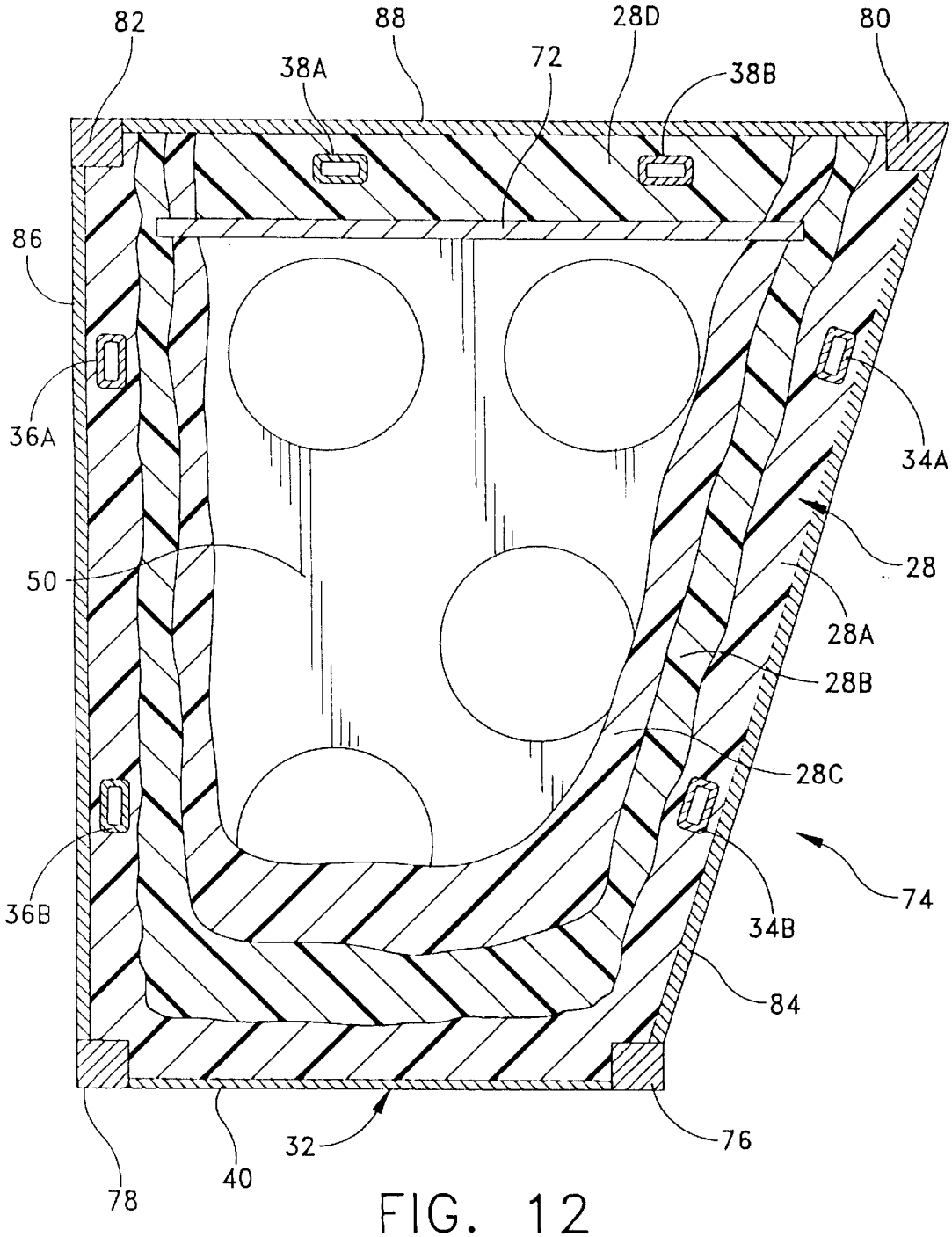
FIG. 12 is a cross-sectional view of an alternative embodiment of the hull construction utilizing metallic exterior skin panels, but having the substantially the same encapsulated foam frame structure.

Although the preferred embodiment is described as having a fiberglass external skin, it is also contemplated that metallic (aluminum) plates can be secured over the side walls and top wall to provide an outer covering to the hull structure. Referring to FIG. 12, a cross-section of a metallic plate hull structure is generally indicated at 74 . The hull construction 74 is similar to the fiberglass embodiment 10 with a few exceptions. The keel plate 32 assembly includes solid rails 76, 78 instead of the spline channel members 42, 44. Similarly, the upper corner members comprise solid rails 80, 82 rather than corner braces 46, 48. Metallic side wall members 84, 86 are welded between the keel plate assembly 32 and the upper corner rails 80, 82. During assembly, the layered foam shell 28 is applied directly into the interior surfaces of the side wall panels 84, 86 and the keel plate 40. The support panel 72 is positioned and then the top layer 28D of foam is applied over the support panel 72. After the foam shell 28 is cured, the metallic top wall plate 88 can be secured, i.e. welded, between the upper corner rails.

It can therefore be seen that the present invention provides a light weight, structurally sound, low cost hull construction which is relatively simple to manufacture. Because of the interior foam shell 28, the hulls 12, 14 are also a highly buoyant, extremely safe and unlikely to sink. The provision of a foam encapsulating shell 28 adds structural integrity to the frame construction 26 and permits the structural frame 26 to be constructed from lighter weight materials than if the frame were not encapsulated in foam. Furthermore, the integrated fire suppression system provides added safety to the boat. For these reasons, the instant invention is believed to represent a significant advancement in the art which has substantial commercial merit.

While the particular marine vessel and hull construction herein disclosed is that of a dual hull vessel, it is to be understood that the hull construction of the instant invention is equally well suited for vessels of other configurations, including both power and sail boats of various sizes. Furthermore, it is to be understood that other variations of the skeletal frame structure are also equally applicable. The critical aspect of the skeletal frame is that the load supporting wall portions are encapsulated by the foam shell to provide additional strength in compression. Keeping this in mind, it will be manifest to those skilled in the art that other alternative frame structures may also suitable for accomplishing the same objectives.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A boat hull construction comprising:

a metallic skeletal frame of truss-like configuration including a longitudinally extending keel plate, and a plurality of interconnected external wall structures extending outwardly from opposing side edges of said keel plate;

a synthetic foam shell encapsulating said plurality of wall structures, and covering an interior surface of said keel plate, said encapsulating foam shell increasing the compressive strength of said skeletal frame and thereby preventing buckling of said plurality of wall structures, said keel plate and the outer surfaces of said foam shell cooperating to define an outer configuration of said hull construction, said synthetic foam shell comprising a plurality of layers of foam including an exterior layer of foam having a predetermined density, and further including at least one interior layer of foam having a density which is lower than said density of said exterior layer of foam; and an exterior skin covering said synthetic foam shell.

2. The hull construction of claim 1 wherein said synthetic foam shell is formed from polyurethane foam.

3. The hull construction of claim 1 wherein said exterior skin comprises a resin impregnated glass fiber skin.

4. The hull construction of claim 1 wherein at least a portion of said exterior skin comprises metallic plating.

5. A boat hull construction comprising:

a metallic skeletal frame of truss-like configuration including a longitudinally extending keel plate, and p2 a plurality of interconnected external wall structures extending outwardly from opposing side edges of said keel plate;

a synthetic foam shell encapsulating said plurality of wall structures, and covering an interior surface of said keel plate, said encapsulating foam shell increasing the compressive strength of said skeletal frame and thereby preventing buckling of said plurality of wall structures, said keel plate and the outer surfaces of said foam shell cooperating to define an outer configuration of said hull construction, said synthetic foam shell comprising a layered foam structure having an exterior foam layer comprising a foam composition having a density of between about 20 to about 40 pounds per square foot, an intermediate foam layer comprising a foam composition having a density of between about 5 to about 15 pounds per square foot, and an interior foam layer comprising a foam composition having a density of between about 1 to about 3 pounds per square foot; and an exterior skin covering said synthetic foam shell.

6. The hull construction of claim 5 wherein said exterior foam layer comprises a synthetic foam composition having a density of about 30 pounds per square foot, said intermediate foam layer comprises a synthetic foam composition having a density of about 10 pounds per square foot, and said interior foam layer comprises a synthetic foam composition having a density of about 2 pounds per square foot.

7. The hull construction of claim 6 wherein said exterior foam layer is applied in a thickness of about 0.5 inches, said intermediate foam layer is applied in a thickness of about 1 inch, and said interior foam layer is applied in a thickness of about 2 to about 3 inches.

8. The hull construction of claim 5 wherein each of said foam compositions comprises a polyurethane foam composition.

9. The hull construction of claim 5 wherein said exterior foam layer is applied in a thickness of about 0.5 inches, said intermediate foam layer is applied in a thickness of about 1 inch, and said interior foam layer is applied in a thickness of about 2 to about 3 inches.

10. A boat hull construction comprising:

a metallic skeletal frame of truss-like configuration including a longitudinally extending keel plate, and a plurality of interconnected external wall structures extending outwardly from opposing side edges of said keel plate;

a synthetic foam shell encapsulating said plurality of wall structures, and covering an interior surface of said keel plate, said encapsulating foam shell increasing the compressive strength of said skeletal frame and thereby preventing buckling of said plurality of wall structures, said keel plate and the outer surfaces of said foam shell cooperating to define an outer configuration of said hull construction;

an exterior skin covering said synthetic foam shell; and a fire suppression system including a source of a fire suppression agent, a supply line supplying said fire suppression agent from said source to an interior of said hull, a valve for controlling the supply of said fire suppression agent from said source to an interior of said hull, a sensor located within an interior of said hull, and a sensor control system associated with said sensor and said valve for controlling operation of said valve responsive to said sensor.

11. The boat hull construction of claim 10 wherein said hull is divided into a plurality of compartments, said fire suppression system comprising a plurality of supply lines respectively supplying said fire suppression agent from said source to said compartment, a master valve for controlling the supply of said fire suppression agent from said source to said plurality of compartments, and a plurality of sensors respectively located within said plurality of compartments, said sensor control system operating said master valve responsive to said plurality of sensors.

12. A boat hull construction comprising:

a metallic skeletal frame of truss-like configuration including a longitudinally extending keel plate having first and second opposing side edges and first and second longitudinal spline channel members respectively attached to said first and second opposing side edges of said keel plate, said first and second spline channel members each having an outwardly facing spline channel, first and second side wall structures extending upwardly from said first and second opposing side edges of said keel plate, and a top wall structure extending between said first and second side wall structures;

a synthetic foam shell encapsulating said first and second side wall structures and said top wall structure, and covering an interior surface of said keel plate, said encapsulating foam shell increasing the compressive strength of said skeletal frame and thereby preventing buckling of the first and second side wall and top wall structures, said keel plate and the outer surfaces of said foam shell cooperating to define an outer configuration of said hull construction; and an exterior fiberglass skin covering said first and second side walls said fiberglass skin having terminal edges secured within said spline channel of said first spline channel member and said spline channel of said second spline channel member, said fiberglass skin being adhered to said synthetic foam shell.

13. The boat hull construction of claim 12 wherein said synthetic foam shell is a layered foam structure having an exterior foam layer comprising a foam composition having a density of between about 20 to about 40 pounds per square foot, an intermediate foam layer comprising a foam composition having a density of between about 5 to about 15 pounds per square foot, and an interior foam layer comprising a foam composition having a density of between about 1 to about 3 pounds per square foot.

14. The hull construction of claim 13 wherein said exterior foam layer comprises a synthetic foam composition having a density of about 30 pounds per square foot, said intermediate foam layer comprises a synthetic foam composition having a density of about 10 pounds per square foot, and said interior foam layer comprises a synthetic foam composition having a density of about 2 pounds per square foot.

15. The hull construction of claim 14 wherein said exterior foam layer is applied in a thickness of about 0.5 inches, said intermediate foam layer is applied in a thickness of about 1 inch, and said interior foam layer is applied in a thickness of about 2 to about 3 inches.

16. The hull construction of claim 13 wherein each of said foam compositions comprises a polyurethane foam composition.

17. The hull construction of claim 13 wherein said exterior foam layer is applied in a thickness of about 0.5 inches, said intermediate foam layer is applied in a thickness of about 1 inch, and said interior foam layer is applied in a thickness of about 2 to about 3 inches.

18. The hull construction of claim 12 wherein said synthetic foam shell is formed from polyurethane foam.

19. The boat hull construction of claim 12 further comprising a fire suppression system including a source of a fire suppression agent, a supply line supplying said fire suppression agent from said source to an interior of said hull, a valve for controlling the supply of said fire suppression agent from said source to an interior of said hull, a sensor located within an interior of said hull, and a sensor control system associated with said sensor and said valve for controlling operation of said valve responsive to said sensor.

20. The boat hull construction of claim 19 wherein said hull is divided into a plurality of compartments, said fire suppression system comprising a plurality of supply lines respectively supplying said fire suppression agent from said source to said compartment, a master valve for controlling the supply of said fire suppression agent from said source to said plurality of compartments, and a plurality of sensors respectively located within said plurality of compartments, said sensor control system operating said master valve responsive to said plurality of sensors.

21. A method of constructing a boat hull comprising the steps of:

providing a metallic skeletal frame of truss-like configuration including a longitudinally extending keel plate, a plurality of interconnected external wall structures extending outwardly from said keel plate;

encapsulating said metallic skeletal frame in a foam shell by applying a hardening type uncured foam to the skeletal frame such that said foam substantially entirely covers an interior surface of said keel plate and encapsulates said plurality of external wall structures, said step of encapsulating comprising the steps of applying an exterior layer of hardening type uncured foam having a predetermined density, and further applying to said exterior layer at least one interior layer of hardening type uncured foam having a density which is less than said density of said exterior layer;

curing said foam;

applying an exterior skin over the outer surfaces of said foam.

22. A method of constructing a boat hull comprising the steps of:

providing a metallic skeletal frame of truss-like configuration including a longitudinally extending keel plate, a plurality of interconnected external wall structures extending outwardly from said keel plate;

encapsulating said metallic skeletal frame in a foam shell by applying a hardening type uncured foam to the skeletal frame such that said foam substantially entirely covers an interior surface of said keel plate and encapsulates said plurality of external wall structures, said step of applying said foam including the steps of applying an exterior foam layer comprising a foam composition having a density of between about 20 to about 40 pounds per square foot, an intermediate foam layer comprising a foam composition having a density of between about 5 to about 15 pounds per square foot, and an interior foam layer comprising a foam composition having a density of between about 1 to about 3 pounds per square foot;

curing said foam; and applying an exterior skin over the outer surfaces of said foam.

23. The method of claim 22 wherein said exterior foam layer comprises a foam composition having a density of about 30 pounds per square foot, said intermediate foam layer comprises a foam composition having a density of about 10 pounds per square foot, and said interior foam layer comprises a foam composition having a density of about 2 pounds per square foot.

24. The hull construction of claim 23 wherein said exterior foam layer is applied in a thickness of about 0.5 inches, said intermediate foam layer is applied in a thickness of about 1 inch, and said interior foam layer is applied in a thickness of about 2 to about 3 inches.

25. The hull construction of claim 22 wherein said exterior foam layer is applied in a thickness of about 0.5 inches, said intermediate foam layer is applied in a thickness of about 1 inch, and said interior foam layer is applied in a thickness of about 2 to about 3 inches.

26. A method of constructing a boat hull comprising the steps of:

providing a metallic skeletal frame including a longitudinally extending keel plate having first and second opposing side edges and first and second longitudinal spline channel members respectively attached to said first and second opposing side edges of said keel plate, said first and second spline channel members each having an outwardly facing spline channel, first and second side wall structures extending upwardly from said first and second opposing side edges of said keel plate, and a top wall structure extending between said first and second side wall structures;

fitting first and second side wall forms over said first and second side wall structures;

applying a hardening type uncured foam to the bottom and side areas of said skeletal frame such that said foam substantially entirely covers an interior surface of said keel plate and encapsulates said first and second side wall structures;

suspending a support panel in said uncured foam;

applying a hardening type uncured foam to the top area of said skeletal frame over said support panel;

removing said forms wherein said keel plate and the outer surfaces of said foam cooperate to define an outer configuration of said hull structure;

curing said foam;

applying an exterior fiberglass skin over the outer surfaces of said foam, said fiberglass skin having terminal edges secured within said spline channel of said first spline channel member and said spline channel of said second spline channel member; and curing the fiberglass resin of said fiberglass skin so that the fiberglass skin is directly adhered to the outer surface of said foam.

27. The method of claim 26 wherein said step of applying said foam includes the steps of applying an exterior foam layer comprising a foam composition having a density of between about 20 to about 40 pounds per square foot, an intermediate foam layer comprising a foam composition having a density of between about 5 to about 15 pounds per square foot, and an interior foam layer comprising a foam composition having a density of between about 1 to about 3 pounds per square foot.

28. The method of claim 27 wherein said exterior foam layer comprises a foam composition having a density of about 30 pounds per square foot, said intermediate foam layer comprises a foam composition having a density of about 10 pounds per square foot, and said interior foam layer comprises a foam composition having a density of about 2 pounds per square foot.

29. The hull construction of claim 28 wherein said exterior foam layer is applied in a thickness of about 0.5 inches, said intermediate foam layer is applied in a thickness of about 1 inch, and said interior foam layer is applied in a thickness of about 2 to about 3 inches.

30. The hull construction of claim 27 wherein said exterior foam layer is applied in a thickness of about 0.5 inches, said intermediate foam layer is applied in a thickness of about 1 inch, and said interior foam layer is applied in a thickness of about 2 to about 3 inches.

* * * * *